US005924300A

United States Patent [19]

Fromm et al.

[11] Patent Number: 5,924,300

[45] Date of Patent: Jul. 20, 1999

[54] MODULAR SELF CONTAINED AIR CONDITIONING UNIT

[75] Inventors: Dale E. Fromm, Onalaska; Walter Earhart, Jr.; William A. Smiley, III, both of La Crosse, all of Wis.; Dwayne L. Johnson, La Crescent, Minn.; Mark E. Smith, Waco, Tex.

[73] Assignee: American Standard Inc., Piscataway, N.J.

[21] Appl. No.: 09/095,305

[22] Filed: Jun. 10, 1998

[51] Int. Cl.[6] ..... F25D 23/12

[52] U.S. Cl. ..... 62/259.1; 62/407; 62/411; 62/419; 62/296; 165/120; 165/122; 454/906

[58] Field of Search ..... 62/407, 411, 419, 62/296, 298; 165/120, 122; 454/906

[56] References Cited

U.S. PATENT DOCUMENTS

| | | | |
|---|---|---|---|
| 3,743,439 | 7/1973 | Cann | 415/206 |
| 4,136,529 | 1/1979 | McCarty | 62/280 |
| 4,155,529 | 5/1979 | Maudlin | 248/604 |
| 4,199,302 | 4/1980 | Goettl | 415/201 |
| 4,375,752 | 3/1983 | Stocking et al. | 62/150 |
| 4,378,679 | 4/1983 | Stocking et al. | 62/280 |
| 4,382,369 | 5/1983 | Stocking | 62/280 |
| 4,524,588 | 6/1985 | Bond | 62/262 |
| 4,660,676 | 4/1987 | Eustace | 181/224 |
| 4,877,106 | 10/1989 | Neville et al. | 181/224 |
| 5,060,720 | 10/1991 | Wollaber et al. | 165/122 |
| 5,094,089 | 3/1992 | Lail | 62/429 |
| 5,121,613 | 6/1992 | Cox et al. | 62/419 |
| 5,152,336 | 10/1992 | Wollaber et al. | 165/75 |
| 5,272,889 | 12/1993 | Harris | 62/429 |
| 5,299,430 | 4/1994 | Tsuchiyama | 62/180 |
| 5,335,721 | 8/1994 | Wollaber et al. | 165/122 |
| 5,372,189 | 12/1994 | Tsunekawa et al. | 62/262 |
| 5,373,894 | 12/1994 | Tomatsuri | 165/134.1 |
| 5,490,557 | 2/1996 | Taylor | 165/54 |
| 5,492,456 | 2/1996 | Knight et al. | 417/360 |
| 5,775,123 | 7/1998 | Wakayama et al. | 62/407 |

OTHER PUBLICATIONS

"Self–Contained Unit Ventilator Heat Pump and Air Conditioning Models", UV–DS–2, Jul. 1997.

"Air Cooled Self–Contained Unit Ventilator Heat Pump and Air Conditioner Models THPB, TACB", TSCB–IOM–1, Jun. 1997.

*Primary Examiner*—Henry Bennett
*Assistant Examiner*—Mark Shulman
*Attorney, Agent, or Firm*—William J. Beres; William O'Driscoll; Peter D. Ferguson

[57] ABSTRACT

An air conditioning system. The system comprises an indoor section and an outdoor section arranged in side-by-side arrangement. The indoor section includes an indoor tangential fan having an axis aligned in a first direction, an indoor heat exchange coil, and a supply air aperture which longitudinally extends in the first direction and avoids line of sight noise transmission from the indoor fan. The system includes an axis commonly supporting and operably coupling the indoor fan and the motor, and a scroll housing within the indoor section and arranged about the indoor tangential fan. The indoor tangential fan, motor and axis are assembled to form a first module, the scroll housing forms a second module and the first module is independently removable from the second module without the necessity of disengaging any connection between the first and second modules. The system includes a fan support bracket supporting a first end of the axis, and the motor supporting a second end of the axis. The fan support bracket includes a bearing assembly rotatably supporting the axis and having a flange; a support bracket including a flange support matingly adapted to engage the flange, a clip adapted to engage a lower end of the bearing assembly support, and an axis aperture adapted to receive the first end of the axis. The system includes a module arranged about and supporting the indoor coil, and a horizontal guide allowing the coil and module to be removed in a horizontal direction.

21 Claims, 5 Drawing Sheets

MODULAR SELF CONTAINED AIR CONDITIONING UNIT

BACKGROUND OF THE INVENTION

The present invention is directed to a modular self contained air conditioning system such as a self contained unit ventilator or similar system having a blower or fan discharging air into a space to be conditioned. More particularly, the present invention is directed to a modular, serviceable and easily accessible fan assembly including a novel bearing support.

A self contained unit ventilator is a typical packaged air conditioner in that it contains a complete air conditioning system including a serially linked indoor heat exchanger, compressor, outdoor heat exchanger, and an expansion device leading back to the indoor heat exchanger. The outdoor heat exchanger is in fluid communication with outdoor ambient air and, unless the unit ventilator is configured as a heat pump, acts as a condenser. The indoor heat exchanger is in fluid communication with the space to be conditioned and typically acts as an evaporator. The self contained unit ventilator is typically used in classroom or hotel applications and the incremental reduction of size in the unit ventilator provides significant competitive advantages.

Typically the indoor and outdoor sections of the unit ventilator are separated from each other by a physical barrier, and each section includes a blower fan moving air through the respective indoor or outdoor heat exchanger. The blower or fan is preferably a cross flow tangential blower having a scroll housing about the blower where the blower discharge leads into a discharge/diffuser duct. The scroll housing radially expands about the blower and guides the blower discharge into that diffuser duct. A cutoff separates the blower input from the blower discharge. Often, the barrier runs the longitudinal length of the unit ventilator such that the outdoor section is behind and obstructed by the indoor section when viewed from the space being conditioned. The outdoor section can usually be serviced only by removing the indoor section to obtain access. Additionally, it is difficult to access and/or to remove the components for service or maintenance.

For purposes of the present invention, the term blower and the term fan are used interchangeably and are intended to apply to all air moving devices. Additionally, this application is intended to apply to air conditioning systems and heat pump systems, those terms being used interchangeably unless otherwise indicated.

SUMMARY OF THE INVENTION

It is an object, feature and advantage of the present invention to solve the problems of the prior art unit ventilators.

It is a further object, feature and advantage of the present invention to provide common access to all components of a unit ventilator from a single side.

It is a further object, feature and advantage of the present invention to provide front access to all components of the unit ventilator.

It is an object, feature and advantage of the present invention that the components be provided in modular assemblies such that each entire module can be removed for ease of serviceability and maintenance.

It is an object, feature and advantage of the present invention that all components with moving parts or parts requiring maintenance or service be easily removable.

It is an object, feature and advantage of the present invention to provide a unit ventilator which is energy efficient, quiet, cost effective to build, and designed with serviceability in mind.

It is an object, feature and advantage of the present invention to provide a fan mounting arrangement which allows the bearings to be removed with the fan but without the necessity of dismantling the unit.

It is a further object, feature and advantage of the present invention to avoid the requirement of access to the bearing mounting bolts or inter-raised locking collar when removing a blower.

It is yet a further object, feature and advantage of the present invention to allow the use of standard, off-the-shelf bearing mounting flanges instead of custom tooled parts.

It is an object, feature and advantage of the present invention to provide a self-contained air conditioner or heat pump having a single fan for an evaporator and a single fan for a condenser.

It is a further object, feature and advantage of the present invention to access all components for service, maintenance, and cleaning from the front of the unit.

It is yet a further object, feature and advantage of the present invention to provide quiet operation due to a single large fan operating at a low RPM.

It is a further object, feature and advantage of the present invention to provide a more efficient fan and coil application due to larger available space for the fan housing and better airflow distribution through the heat exchange coils.

The present invention provides a self-contained air conditioning unit. The unit comprises a housing; a heat exchanger within the housing; a tangential fan and a motor having a common axis, all within the housing and arranged to move air across the heat exchanger; and a scroll housing within the housing and arranged about the tangential fan. The tangential fan, motor and axis are assembled to form a first module and the scroll housing forms a second module. The first module is independently removable from the second modules without the necessity of disengaging any connection between the first and second modules.

The present invention also provides a fan assembly. The fan assembly comprises a fan; a motor; an axis commonly supporting and operably coupling the fan and the motor; and a fan support bracket supporting a first end of the axis. The motor supports a second end of the axis. A scroll housing is arranged about the fan; and a base assembly supports the fan bracket and the motor. The base assembly is slideably separable as a unit from the scroll housing.

The present invention further provides a blower support assembly. The assembly comprises a blower; an axis of the blower including a motor end and a fan end; a bearing assembly rotatably supporting the fan end of the axis; a bearing assembly support which supports the bearing assembly and includes a flange; and a support bracket. The support bracket includes a flange support matingly adapted to engage the flange, a clip adapted to engage a lower end of the bearing assembly support, and an axis aperture adapted to receive the fan end of the axis.

The present invention still further provides an independently removable coil assembly. The coil assembly comprises a V-shaped heat exchange coil; a module arranged about and supporting the coil; and a horizontal guide allowing the coil and module to be removed in a horizontal direction.

The present invention yet further provides a self-contained unit ventilator. The unit ventilator comprises an outdoor section and an indoor section arranged in a side-by-side arrangement. The indoor section includes return air, supply air and outside air apertures where all the apertures are longitudinally extended and parallel to each other in a first direction. The indoor section also includes a tangential fan arranged in the first direction, and a V-shaped heat exchange coil arranged between the fan and the return air and outside air apertures. The indoor section additionally includes a supply air duct located between the fan and the supply air aperture where the duct extends sidewise substantially the length of the fan and the length of the supply air aperture and has a depth distance between the fan and the supply air aperture that avoids line of sight noise transmission between the fan and the supply air aperture.

The present invention additionally provides a packaged air conditioning system. The system comprises an indoor section and an outdoor section arranged in side-by-side arrangement. The indoor section includes an indoor tangential fan having an axis in a first direction, a V-shaped heat exchanger coil aligned in a second direction perpendicular to the first direction, and a supply air aperture which longitudinally extends in the first direction and avoids line of sight noise transmission from the indoor fan. The indoor fan moves air over the V-shaped coil and out the supply air aperture. The outdoor section includes a heat exchange coil, an outdoor tangential fan moving air over the heat exchange coil and having an axis running in the first direction, and a compressor. The indoor and outdoor tangential fans, and the V-shaped heat exchange coil are modularly arranged to be slideably removed in the second direction.

DETAILED DESCRIPTION OF THE DRAWINGS

Figure 1:
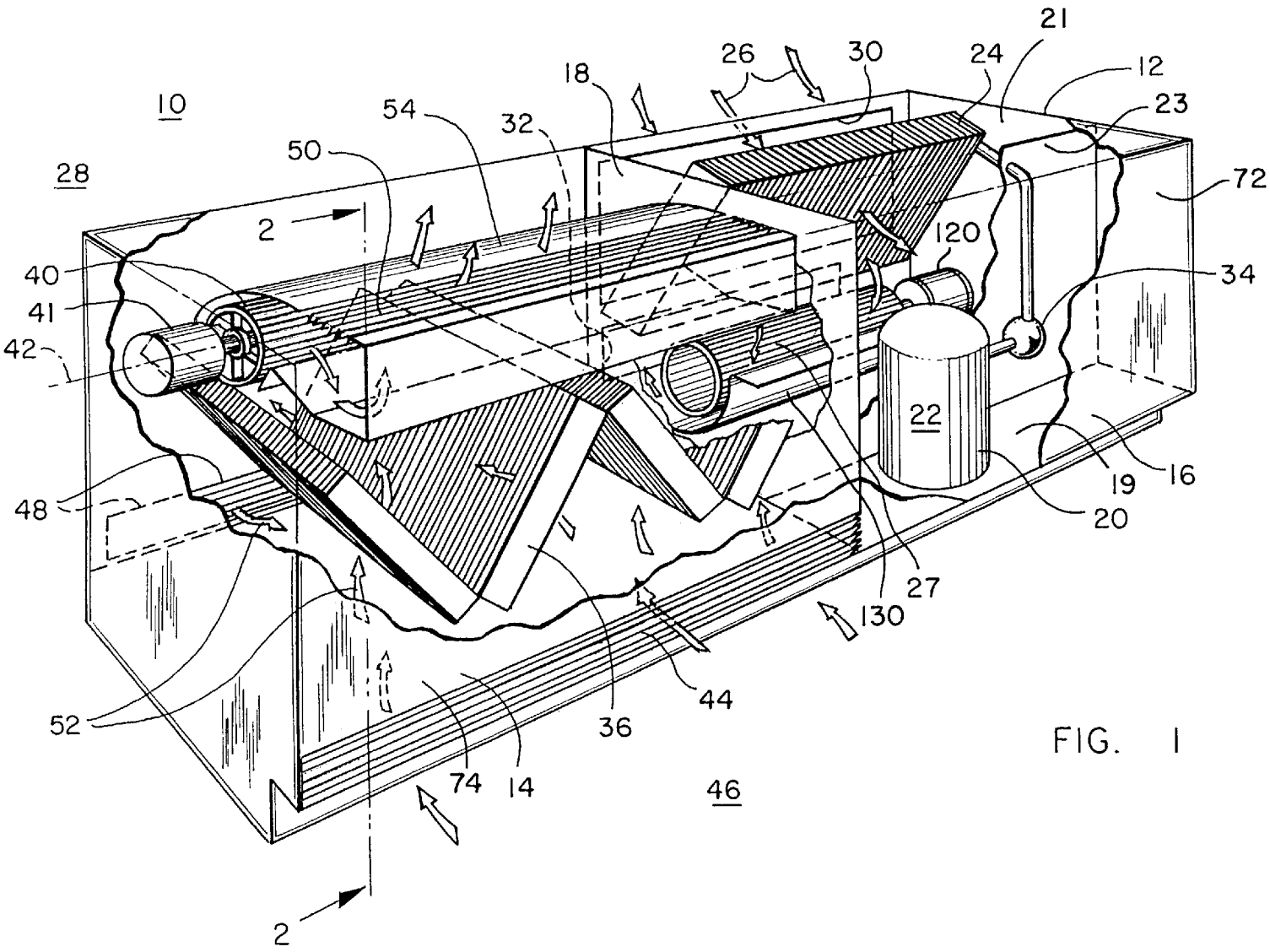
FIG. 1 is a perspective and partial cutaway of a self-contained unit ventilator in accordance with the present invention.
Figure 2:
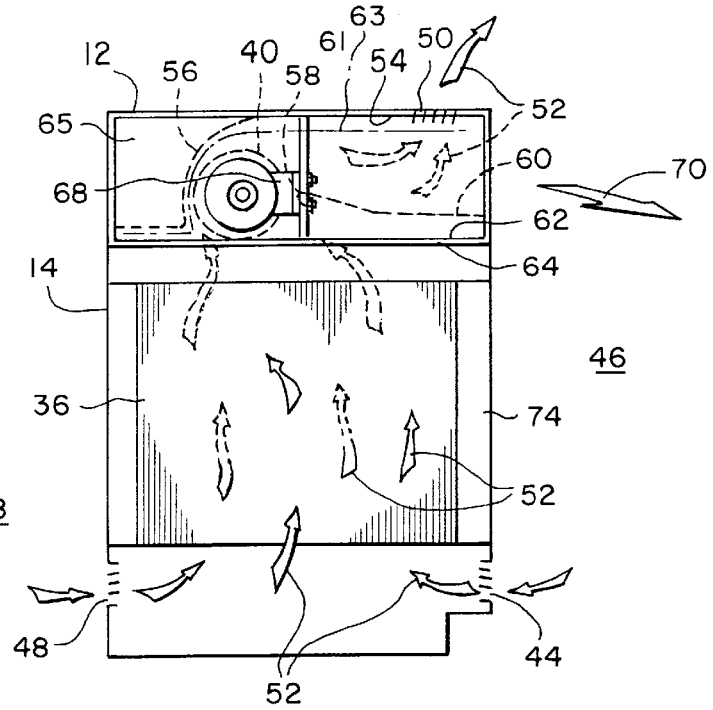
FIG. 2 is a cutaway of FIG. 1 taken along lines 2—2.
Figure 3:
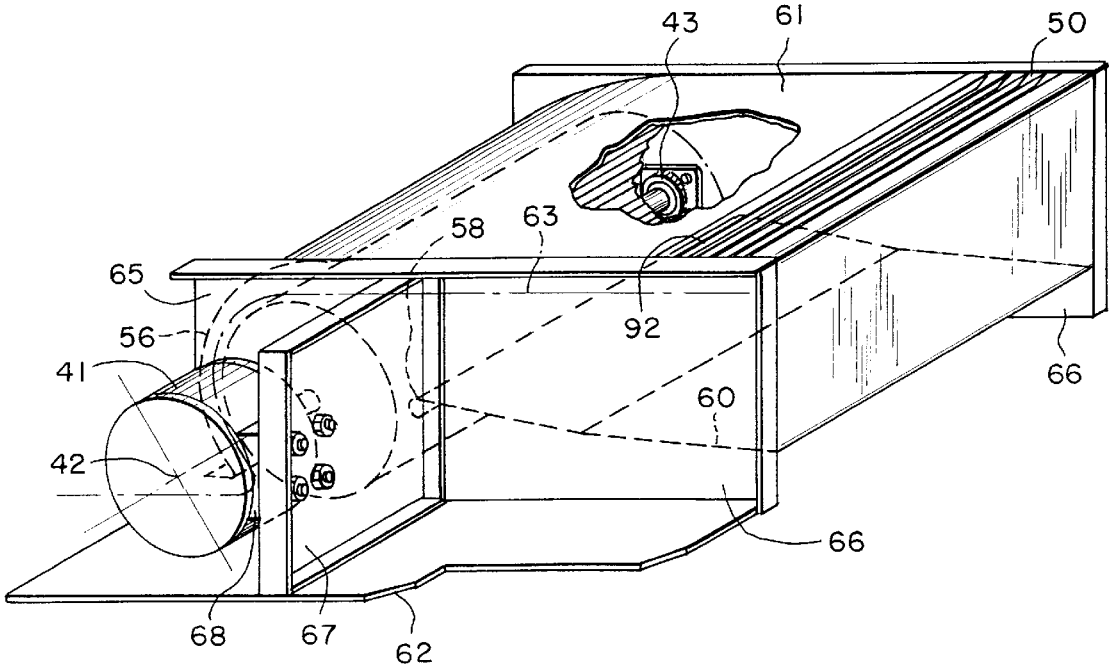
FIG. 3 shows the indoor fan and diffuser assembly of FIG. 2.

FIG. 1 shows a self contained air conditioning system 10 such as a unit ventilator. The system 10 includes a housing 12 surrounding an indoor section 14 and an outdoor section 16. A barrier 18 separates the indoor section 14 from the outdoor section 16.

The housing 12 preferably contains an air conditioning system 20 including a compressor 22 where the compressor discharge is directed to an outdoor heat exchanger 24 typically acting as a condenser. The outside section includes a compressor section 19 and an air movement section 21 separated by a wall 23. The compressor 22 is located in the compressor section 19 and the outdoor heat exchanger 24 is located in the air movement section 21. The air movement section 21 includes an airflow path 26 entering from outside ambient air 28 through an outside air inlet aperture 30. The airflow path 26 passes through the outdoor heat exchanger 24 and returns to the outdoor ambient air 28 through an outside air outlet aperture 32. A blower 27 motivates the air along this airflow path 26 and out the outlet aperture 32.

The air conditioning system 20 also includes one or more expansion devices 34 such as an electronic expansion valve, a thermal expansion valve or the like. The expansion device 34 is connected to the discharge of the outside heat exchanger 24 and controls the flow of refrigerant to an indoor heat exchanger 36. The discharge of the indoor heat exchanger 36 returns to the compressor 22. The indoor heat exchanger 36 is located in the indoor section 14, and the expansion device 34 can be located in either the indoor or outdoor section 14, 16. If the air conditioning system 20 is a heat pump, a reversing valve (not shown) is provided to interchange and reverse the functions of the outdoor heat exchanger 24 and the indoor heat exchanger 36 within the serially linked air conditioning system 20.

The indoor section 14 includes a blower 40 and motor 41 rotatable around a common axis 42 and aligned to draw air over the indoor heat exchanger 36. The indoor section 14 includes a return air inlet 44 bringing return air from the space 46 to be cooled, an outside air inlet 48 bringing in outside air from the ambient air 28, and a supply air discharge duct 54 discharging conditioned supply air back through a discharge aperture 50 into the space 46 to be conditioned.

An airflow path 52 is provided from the return air inlet 44 and from the outside air outlet 48 to pass through the indoor heat exchangers 36, into the blower 40, through the discharge duct 54, and out the discharge aperture 50. A scroll housing is provided about the blower 40 to direct and control the blower's operation. A cutoff 58 and a diffuser section 60 are provided to diffuse and direct the fan's discharge through the discharge duct 54 and the discharge aperture 50, and also to separate to blower intake from the blower discharge. Typically, the diffuser section 60 is a planar section which angles away from a planar section 61 of the discharge duct 54, where the planar section 61 lies between the scroll housing 56 and the discharge aperture 50.

The blower 40 and the diffuser section 60 are supported by an indoor assembly 62 which in turn is slideably mounted on the heat exchanger module 110 forming a part of the housing 12. Sidewalls 66 support the diffuser section 60, the cutoff 58, and the blower 40. The blower 40 is supported by motor 41 affixed to a projecting wall 67 of the sidewall 66 at one end and by a bearing and support assembly 43 affixed to the sidewall 66 at the other end. The scroll housing 56 is not connected with the indoor fan assembly 62 such that the indoor fan assembly 62 can be slid out of the housing in the direction indicated by arrow 70 to remove the blower 40 but not removing the scroll housing 56. Dashed line 63 indicates the preferred separation between the removable assembly 62 and the scroll housing 56 and its support walls 65. Since the scroll housing 56 has no moving parts, little maintenance other than a cleaning is required. In contrast, the removal of the entire blower 40 including all its functioning parts such as its motor 41 allows easy serviceability.

The housing 12 includes removable front panels 72 and 74 respectively covering the sections 16 and 14. These panels 72, 74 are of conventional design and allow access to the interior of the housing 12 once the panels 72, 74 are removed. In the design of the present invention, all the major components are removable in direction 70, including all components with moving parts.

Figure 4:
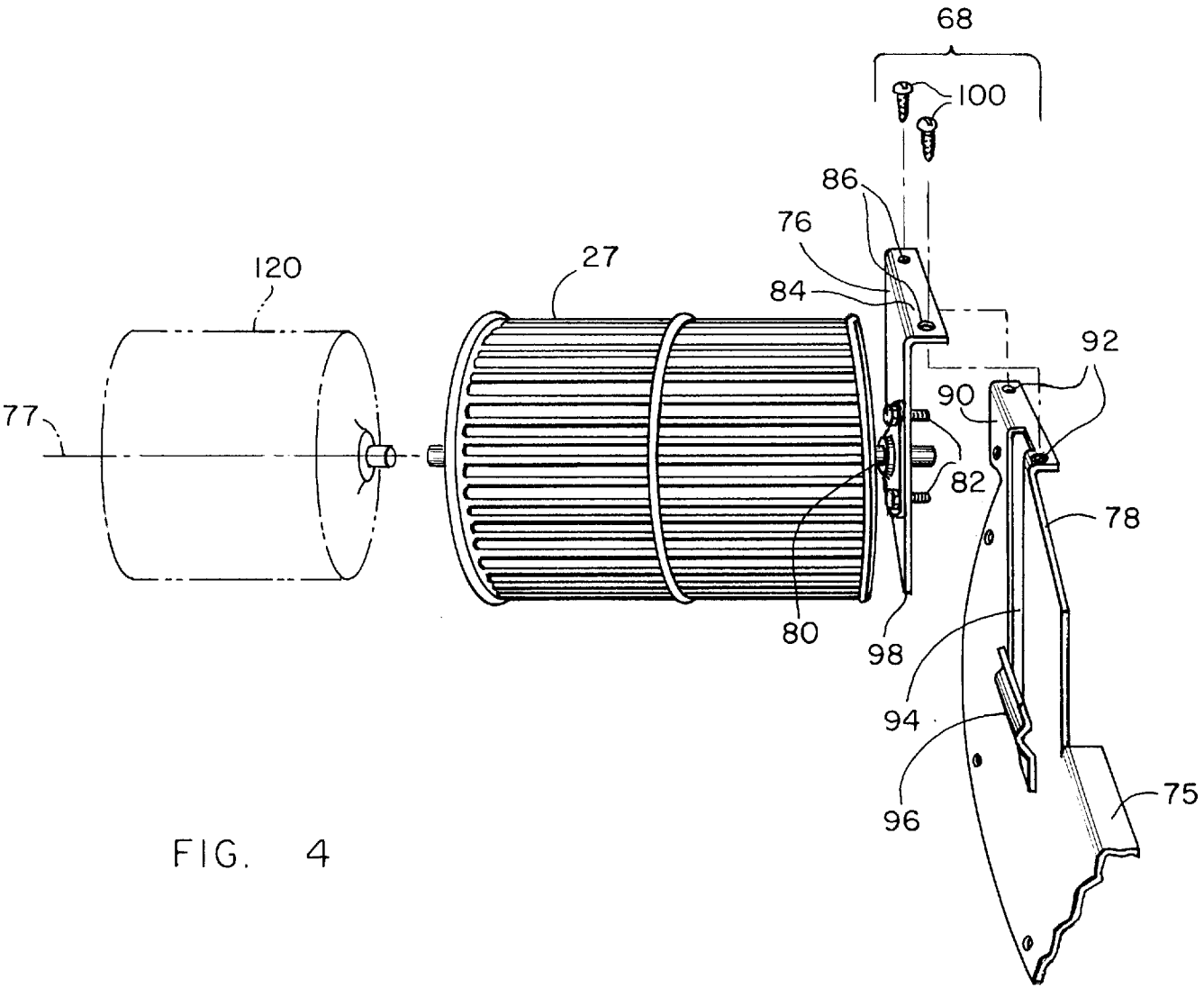
FIG. 4 shows the outdoor fan, fan bearing, and fan bearing support of the present invention as viewed from the rear of the unit ventilator.

FIG. 4 shows the blower 27, a blower support assembly 68, and a portion of a fan base support 75. The assembly 68 includes a bearing assembly support 76 and a blower bracket 78. The axis 77 of the blower 27 includes a bearing assembly 80 conventionally mounted on the bearing assembly support 76 by fasteners 82. The bearing assembly support 76 includes a flange 84 and fastener apertures 86. The bracket 78 includes a flange support 90 with mating apertures 92. The bracket 78 also includes an access aperture 94 and a support clip 96.

To complete the bearing assembly 68, the bearing assembly 76 is positioned on the bracket 78 such that the clip engages a lower end 98 of the bearing assembly support 76, and such that the flange 84 engages the flange support 90. The bearing assembly 80 and the fasteners 82 are located in the longitudinally oriented access aperture 94, and fasteners 100 are inserted to secure the flange 84 to the flange support 90 through the apertures 86 and 92. The fasteners 100 are accessible from above and, once the fasteners 100 are removed, the entire blower 27 and blower assembly support 76 can be lifted from the fan base support 75. No access to mounting bolts or inter-raised locking collars is required. The bracket 78 is formed from standard off-the-shelf bearing mounting flanges instead of custom tooled parts.

Figure 5:
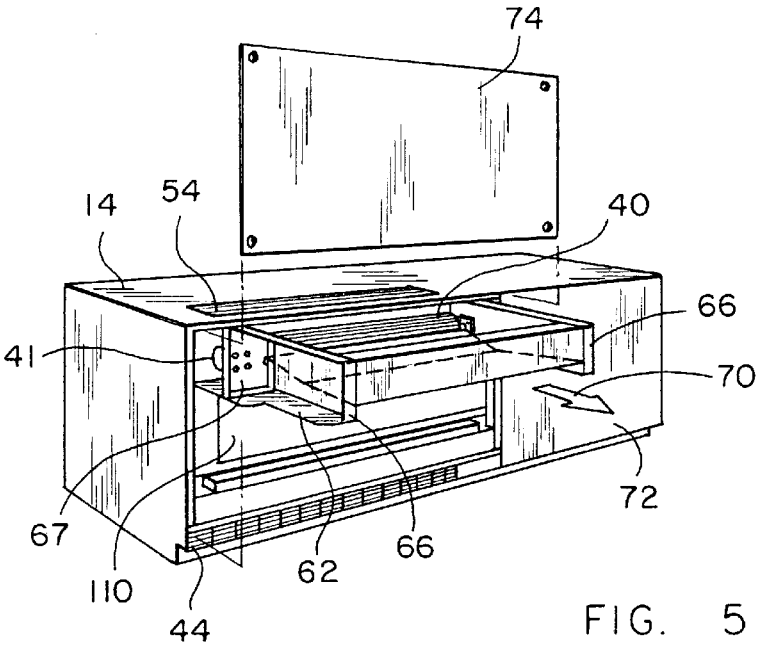
FIG. 5 shows the modular arrangement of the indoor blower.

FIG. 5 illustrates how the indoor fan assembly 62 is removed. The front panel 74 is taken off, and several conventional fasteners (not shown) are removed. The fan assembly 62 then slides out of the housing 12 in direction 70 along the top of the module 110 to allow access to the blower 40 and motor 41.

Figure 6:
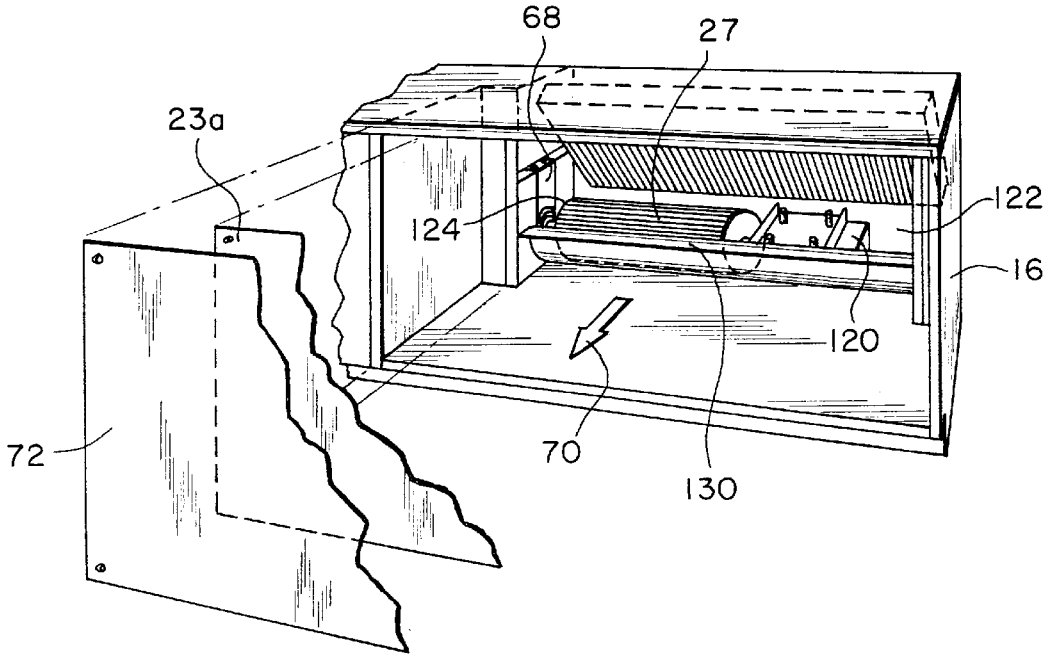
FIG. 6 shows the modular arrangement of the outdoor blower.

As shown in FIG. 6, a similar arrangement is used to allow the blower 27 to be removed from the housing 16. To service the blower 27 or its motor 120, the panel 72 is removed and then a portion 23*a* of the wall 23 is removed. This allows a space 122 above the motor 120 and the blower 27 to be accessed such that several conventional fasteners holding the motor 120 in place can be removed and the motor 120 decoupled from the blower 27. The motor 120 can then be removed for service by first lifting the motor 120 up and then out in direction 70. Although the blower's distal end 124 is not directly accessible, the distal end 124 is mounted by the blower support assembly 68 which only requires the removal of the two fasteners 100 to release the distal end 124 of the blower 27. The blower 27 has a scroll housing 130 arranged about it but without positive connections between the blower 27 and the scroll housing 130 such that the blower can be removed independently of the scroll housing 130. The blower 27 then can be moved into the space vacated by the motor 120, lifted up and moved forward in direction 70 for service. However, typically, the blower 27 needs little service. Reassembly is a reversal of the disassembly steps.

Figure 7:
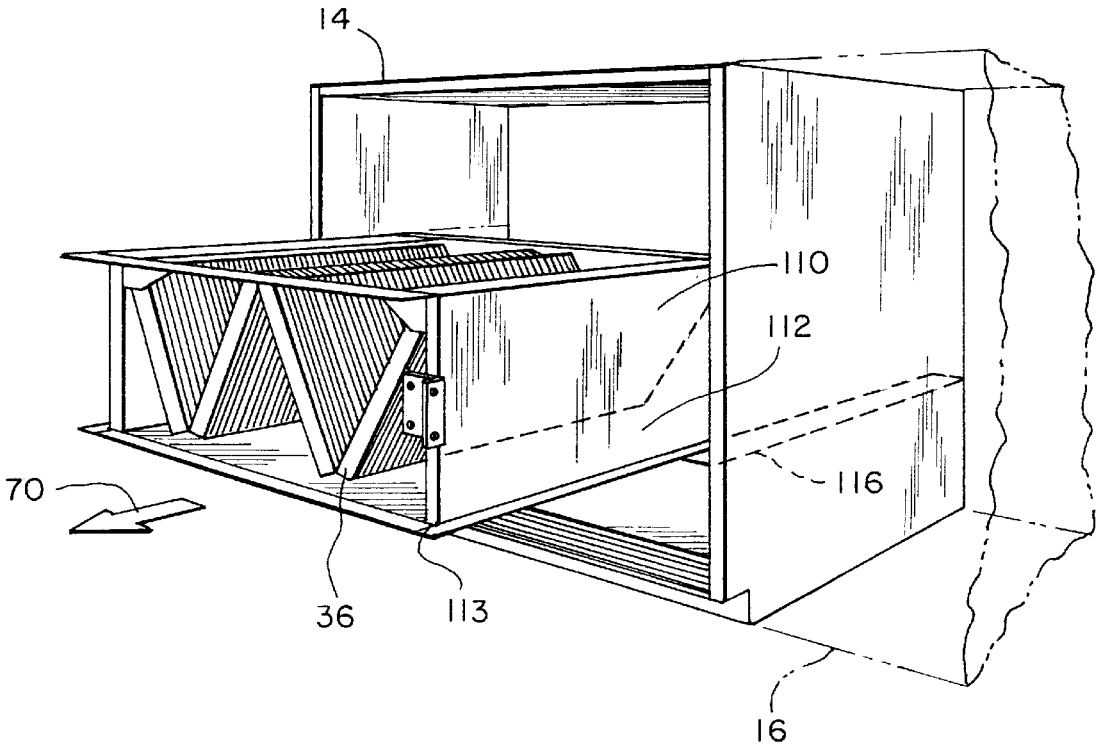
FIG. 7 shows the modular arrangement of the indoor heat exchange coils.

Similarly with regard to FIG. 7, the indoor heat exchanger 36 is within and supported by the heat exchanger module 110 including sides 112 and a base 113. After decircuiting the heat exchanger 36, the module 110 is slideable along support rails 116 to allow removal of the entire module 110 in the direction 70. The indoor heat exchanger 36 can then be easily serviced. The indoor fan assembly 62 rests directly on the module 110 and is preferably held in place with several screws. To service the blower 40, the panel 74 is removed and the screws are removed. The indoor fan assembly 62 is then slid out in direction 70 allowing easy access to the blower 40 and the motor 41. Likewise, to service the module 110, the indoor fan assembly 62 must first be removed. Then, several fasteners such as screws are removed and the entire module 110 is removed in direction 70. Reassembly is a reversal of the disassembly steps.

The present invention provides an air conditioning system such as a unit ventilator which is serviceable from a single side including a modular arrangement that allows all moving parts to be removed. It will be apparent to a person of ordinary skill in art that many variations in this arrangement are contemplated. All such variations and modifications are within the spirit and scope of the claimed invention.

What is desired to be secured for Letters Patent of the United States is set forth in the following claims.

We claim:

1. An air conditioning system comprising:

an indoor section and an outdoor section arranged in side-by-side arrangement;

the indoor section including an indoor tangential fan having an axis aligned in a first direction, an indoor heat exchange coil, and a supply air aperture which longitudinally extends in the first direction and avoids line of sight noise transmission from the indoor fan, the indoor fan arranged to move air over the heat exchange coil and out the supply air aperture.

2. An air conditioning system comprising:

an indoor section and an outdoor section arranged in side-by-side arrangement;

the indoor section including an indoor tangential fan having an axis aligned in a first direction, an indoor heat exchange coil, and a supply air aperture which longitudinally extends in the first direction and avoids line of sight noise transmission from the indoor fan, the indoor fan arranged to move air over the heat exchange coil and out the supply air aperture; and a first scroll housing about the indoor tangential fan wherein the indoor tangential fan is removable without disconnection from the first scroll housing.

3. The system of claim 2:

wherein the outdoor section includes an outdoor heat exchange coil, an outdoor tangential fan moving air over the outdoor heat exchange coil and having an axis aligned in the first direction, and a compressor; and wherein the indoor and outdoor tangential fans, and the indoor heat exchange coil are modularly arranged to be slideably removed in a second direction perpendicular to the first direction.

4. The system of claim 3 further including a second scroll housing arranged about the outdoor tangential fan wherein the outdoor fan is removable independently of the outdoor scroll housing.

5. The system of claim 4 wherein the indoor heat exchange coil is a V-shaped heat exchanger coil aligned in the second direction perpendicular to the first direction.

6. The system of claim 5 wherein the indoor section includes a return air aperture, the supply air aperture and an outside air aperture where all the apertures are longitudinally extended and parallel to each other in the first direction;

the V-shaped heat exchange coil is arranged between the fan and the return air and outside air apertures.

7. The system of claim 6 wherein the V-shaped coil, the outdoor heat exchange coil and the compressor are serially linked in an air conditioning system.

8. The system of claim 7 further including an independently removable coil assembly, the assembly including:

the V-shaped heat exchange coil;

a module arranged about and supporting the coil;

a horizontal guide allowing the coil and module to be removed in the second direction.

9. The system of claim 8 further including a fan assembly directly supported by the module wherein the fan assembly includes the indoor tangential fan and is independently removable in the second direction.

10. The system of claim 9 further including:

a motor affixed within the outdoor section;

an axis commonly supporting and operably coupling the outdoor tangential fan and the motor, a fan support bracket supporting a first end of the axis, the motor supporting a second end of the axis;

the fan support bracket including a bearing assembly rotatably supporting the axis, a bearing assembly support which supports the bearing assembly and includes a flange, a support bracket including a flange support matingly adapted to engage the flange, a clip adapted to engage a lower end of the bearing assembly support, and an axis aperture adapted to receive the first end of the axis.

11. An air conditioning system comprising:

an indoor section and an outdoor section arranged in side-by-side arrangement;

the indoor section including an indoor tangential fan having an axis aligned in a first direction, an indoor heat exchange coil, and a supply air aperture which longitudinally extends in the first direction and avoids line of sight noise transmission from the indoor fan, the indoor fan arranged to move air over the heat exchange coil and out the supply air aperture;

an independently removable coil assembly, the assembly including:

the indoor heat exchange coil;

a module arranged about and supporting the coil;

a horizontal guide allowing the coil and module to be removed in the second direction.

12. The system of claim 11 further including a fan assembly directly supported by the module wherein the fan assembly includes the indoor tangential fan and is independently removable in the second direction.

13. An air conditioning system comprising:

an indoor section and an outdoor section arranged in side-by-side arrangement; the indoor section including an indoor tangential fan having an axis aligned in a first direction, an indoor heat exchange coil, and a supply air aperture which longitudinally extends in the first direction and avoids line of sight noise transmission from the indoor fan, the indoor fan arranged to move air over the heat exchange coil and out the supply air aperture;

a motor affixed within the outdoor section;

an axis commonly supporting and operably coupling the outdoor tangential fan and the motor, a fan support bracket supporting a first end of the axis, the motor supporting a second end of the axis; and the fan support bracket including a bearing assembly rotatably supporting the axis, a bearing assembly support which supports the bearing assembly and includes a flange, a support bracket including a flange support matingly adapted to engage the flange, a clip adapted to engage a lower end of the bearing assembly support, and an axis aperture adapted to receive the first end of the axis.

14. A self-contained air conditioning unit comprising:

a housing;

a heat exchanger within the housing;

a tangential fan and a motor having a common axis, all within the housing and arranged to move air across the heat exchanger; and a scroll housing within the housing and arranged about the tangential fan;

wherein the tangential fan, motor and axis are assembled to form a first module and the scroll housing forms a second module and wherein the first module is independently removable from the second module without the necessity of disengaging any connection between the first and second modules.

15. The unit of claim 14 wherein the first module is removable in a horizontal direction.

16. The unit of claim 15 further including a fan base, a bracket supported by the fan base, and a bearing support assembly removably attached to the bracket, wherein the bearing support assembly supports the common axis.

17. The unit of claim 16 wherein the bearing support assembly includes flange and wherein the bracket includes a fan support, a clip and an aperture adapted to receive the axis.

18. An air conditioning system comprising:

an indoor section and an outdoor section arranged in side-by-side arrangement;

the indoor section including an indoor tangential fan having an axis aligned in a first direction, an indoor heat exchange coil, and a supply air aperture which longitudinally extends in the first direction and avoids line of sight noise transmission from the indoor fan, the indoor fan arranged to move air over the heat exchange coil and out the supply air aperture;

an axis commonly supporting and operably coupling the indoor fan and the motor;

a scroll housing within the indoor section and arranged about the indoor tangential fan;

wherein the tangential fan, motor and axis are assembled to form a first module and the scroll housing forms a second module and wherein the first module is independently removable from the second module without the necessity of disengaging any connection between the first and second modules;

a fan support bracket supporting a first end of the axis;

the motor supporting a second end of the axis;

the fan support bracket including a bearing assembly rotatably supporting the axis and including a flange, a support bracket including a flange support matingly adapted to engage the flange, a clip adapted to engage a lower end of the bearing assembly support, and an axis aperture adapted to receive the first end of the axis;

a module arranged about and supporting the indoor coil; and a horizontal guide allowing the coil and module to be removed in a horizontal direction.

19. A fan assembly comprising:

a fan;

a motor; and an axis commonly supporting and operably coupling the fan and the motor;

a fan support bracket supporting a first end of the axis;

the motor supporting a second end of the axis;

the fan support bracket including a bearing assembly rotatably supporting the fan end of the axis, a bearing assembly support which supports the bearing assembly and includes a flange, a support bracket including a flange support matingly adapted to engage the flange, a clip adapted to engage a lower end of the bearing assembly support, and an axis aperture adapted to receive the first end of the axis.

20. An independently removable coil assembly comprising:

a V-shaped heat exchange coil;

a module arranged about and supporting the coil;

a horizontal guide allowing the coil and module to be removed in a horizontal direction.

21. The assembly of claim 20 further including a fan assembly directly supported by the module wherein the fan assembly is independently removable in the horizontal direction.

* * * * *